US012007190B2

(12) United States Patent
Schrödl

(10) Patent No.: US 12,007,190 B2
(45) Date of Patent: Jun. 11, 2024

(54) CONNECTION FOR CONNECTING UPPER AND LOWER RECEIVER OF A WEAPON

(71) Applicant: SAKO OY, Riihimäki (FI)

(72) Inventor: Christoph Schrödl, Porvoo (FI)

(73) Assignee: SAKO OY, Riihimäki (FI)

( * ) Notice: Subject to any disclaimer, the term of this patent is extended or adjusted under 35 U.S.C. 154(b) by 0 days.

(21) Appl. No.: 17/924,421

(22) PCT Filed: May 12, 2021

(86) PCT No.: PCT/FI2021/050352
§ 371 (c)(1),
(2) Date: Nov. 10, 2022

(87) PCT Pub. No.: WO2021/234219
PCT Pub. Date: Nov. 25, 2021

(65) Prior Publication Data

US 2023/0184499 A1 Jun. 15, 2023

(30) Foreign Application Priority Data

May 20, 2020 (FI) ..... 20205511

(51) Int. Cl.
*F41A 3/66* (2006.01)

(52) U.S. Cl.
CPC ..... *F41A 3/66* (2013.01)

(58) Field of Classification Search
CPC ..... F41A 3/66
See application file for complete search history.

(56) References Cited

U.S. PATENT DOCUMENTS

| | | | | |
|---|---|---|---|---|
| 10,578,380 | B2 * | 3/2020 | Jen | F41A 11/00 |
| 2017/0299292 | A1 | 10/2017 | Daley, Jr. | |
| 2018/0017347 | A1 | 1/2018 | Chang et al. | |
| 2018/0313618 | A1 | 11/2018 | Timmons | |
| 2019/0072123 | A1 | 3/2019 | Adams et al. | |

OTHER PUBLICATIONS

International Search Report and Written Opinion in Application No. PCT/FI2021/050352, dated Aug. 12, 2021, 12 pages.
Search Report in Finnish Application No. 20205511 dated Dec. 8, 2020, 1 page.

* cited by examiner

*Primary Examiner* — Reginald S Tillman, Jr.
(74) *Attorney, Agent, or Firm* — Meunier Carlin & Curfman LLC

(57) ABSTRACT

Connection for connecting an upper receiver to a lower receiver of a weapon, which connection comprises front and rear take-down pins, and through-holes formed in both receivers for inserting the take-down pins through these holes to connect the upper and lower receiver to each other, wherein the rear take-down pin comprises an eccentric portion at its length for tightening the receivers against each other by turning the rear take-down pin.

10 Claims, 3 Drawing Sheets

CONNECTION FOR CONNECTING UPPER AND LOWER RECEIVER OF A WEAPON

CROSS REFERENCES

This application is a United States National Phase Patent Application of International Patent Application Number PCT/FI2021/050352, filed on May 12, 2021, which claims the benefit of priority to FI Application No. 20205511, filed May 20, 2020.

FIELD OF THE INVENTION

The present invention relates to an improved connection for connecting an upper receiver and a lower receiver of a weapon, especially an AR-type weapon.

BACKGROUND OF THE INVENTION

AR-type weapons are typically automatic or semi-automatic rifles. An example of an AR-type weapon is AR-15. AR-type weapons typically comprise an upper receiver and a lower receiver, which are connected together and to which receivers other parts of the weapon are connected, either directly or indirectly. In the lower receiver is typically connected a buffer system, a trigger mechanism, and a magazine for example, and in the upper receiver is typically connected a barrel and a bolt carrier group for example.

The connection between the upper receiver and lower receiver is implemented with two take-down pins, a front take-down pin, or front pivot pin, and a rear take-down pin. This connection between the upper and lower receiver is very important, since any play or slack between the receivers will cause problems for the operation and especially accuracy of the weapon itself.

For removing the play or slack caused by manufacturing tolerances or wear a piece or flexible material can be used at the location of the rear take-down pin, which pushes the upper receiver's connection part against the rear take-down pin. This solution requires separate additional parts, which can wear down or be lost, which can create problems in demanding operating conditions.

SUMMARY OF THE INVENTION

The present invention provides improved connection between the upper receiver and lower receiver of AR-type weapon, which fixes the upper and lower receiver to each other and removes any play between the receivers.

In the present invention in the rear take-down pin is formed an eccentric section, which allows tightening of the upper receiver against lower receiver by rotating the take-down pin when it is at its place. Thus, any play between the receivers is removed without any separate additional parts. By removing the play or slack between the receivers rigidly with the rear take-down pin of the invention allows increased durability and lifetime of the connection between the receivers, since in the prior art solutions the recoil induced momentum around the front take-down pin increases the slack over time as a result of forging effects in the through-hole for the rear take-down pin in the upper receiver, which makes this through-hole increasingly oval.

The connection of the present invention for connecting an upper receiver to a lower receiver of a weapon comprises front and rear take-down pins, and through-holes formed in both receivers for inserting the take-down pins through these holes to connect the upper and lower receiver to each other, wherein the rear take-down pin comprises an eccentric portion at its length for tightening the receivers against each other by turning the rear take-down pin.

In an embodiment of the connection of the invention the eccentric portion of the rear take-down pin is located at least at the area of the through-hole formed in the upper receiver when the rear take-down pin is at its place. Preferably the eccentric portion extends from the end of the rear take-down pin to the area located next to a wall of the lower receiver when the rear take-down pin is at its place.

In an embodiment of the connection of the invention the cross-sectional area of the rear take-down pin is smaller within the eccentric portion than outside the eccentric portion. In other words, the eccentricity in the rear take-down pin is obtained by removal of material from the pin portion of the rear take-down pin in relation to the prior art take-down pins.

In an embodiment of the connection of the invention the rear take-down pin is formed a groove or recess for facilitating the turning of the rear take-down pin with a tool. Preferably the formed groove is dimensioned such, that the rear take-down pin can be turned with an edge of a cartridge or its shell. Further, the opposite end surface of the rear take-down pin may, additionally or alternatively, be equipped with a groove or recess, such as a hexagonal hole for example, for facilitating the turning of the rear take-down pin with a tool.

In an embodiment of the connection of the invention the connection comprises a first spring-loaded locking pin located in a first channel formed inside a wall of the lower receiver, which first locking pin is configured to prevent the complete removal of the rear take-down pin from the lower receiver, and wherein the rear take-down pin comprises a groove extending along part of the length of the pin portion of the rear take-down pin in which groove the head of the first locking pin sets and which groove allows the rear take-down pin to the be slid through the through-hole formed in the upper receiver. In this embodiment the groove also comprises a portion, which extends close to the head of the rear take-down pin partially around the surface of the pin at the area located in the through-hole of the rear receiver when the rear take-down pin is at its place.

In an embodiment of the connection of the invention the connection comprises a second spring-loaded locking pin located in a second channel formed inside a wall of the lower receiver, which second locking pin is configured to prevent the rotating of the rear take-down pin in at least a first rotational direction, and wherein the rear take-down pin comprises a recess for receiving the head of the second locking pin.

In the above embodiment there are preferably a plurality of recesses for receiving the head of the second locking pin formed in circumference of the rear take-down pin, which recesses are formed so, that the side walls of the recesses push the head of the second locking pin out of the recess when the rear take-down pin is rotated in an opposite rotational direction in relation to the first rotational direction.

In an embodiment of the connection of the invention the connection further comprises a flexible piece fixed inside the lower receiver, which piece deforms when the upper receiver is pressed against the lower receiver in order to at least partially align the through-holes in the upper receiver and in the lower receiver for insertion of the rear take-down pin. The flexible piece fixed inside the lower receiver is preferably a rubber piece glued in the lower receiver.

In an embodiment of the connection of the invention the through-hole formed in the upper receiver for the rear take-down pin comprises a metal bushing. This metal bushing increases the durability and rigidity of the through-hole, especially since the upper receiver is typically made of aluminium alloy. The metal bushing is preferably made of steel.

More precisely the features defining a connection in accordance with the present invention are presented in claim 1. Dependent claims present advantageous features and embodiments of the invention.

Exemplifying embodiment of the invention and its advantages are explained in greater detail below in the sense of example and with reference to accompanying drawings, where

DETAILED DESCRIPTION OF THE INVENTION

Figure 1:
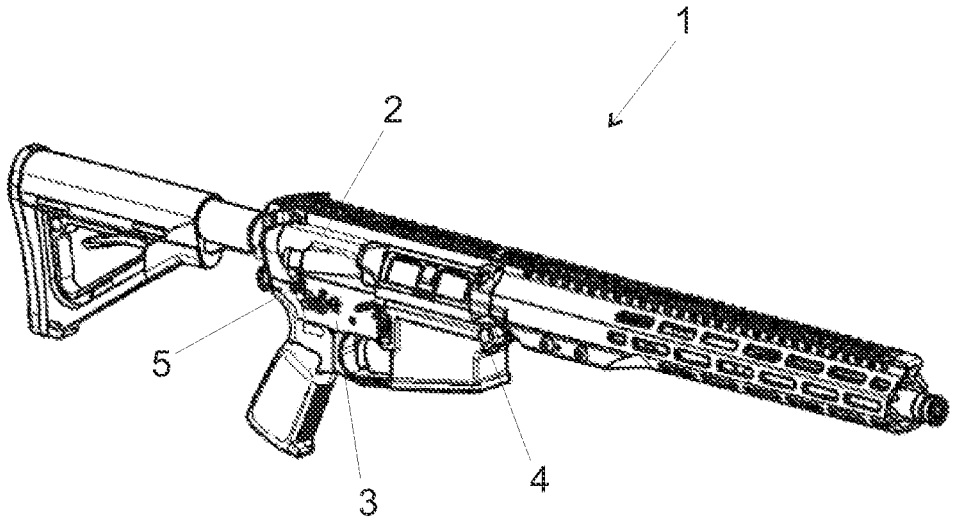
FIG. 1 shows schematically an embodiment of a weapon in the present invention can be utilized.

FIG. 1 shows schematically an embodiment of a weapon 1, which in this embodiment is an AR-type rifle, in which the connection of the invention between an upper receiver 2 and a lower receiver 3 can be implemented. Typically in AR-type weapons the connection between the upper receiver 2 and lower receiver 3 comprises a front take-down pin 4 and a rear take-down pin 5, which pins in fixed position extends through the sidewalls of the lower receiver and between these sidewalls through a part of the upper receiver via through-holes formed in the lower and upper receiver.

Figure 2A:
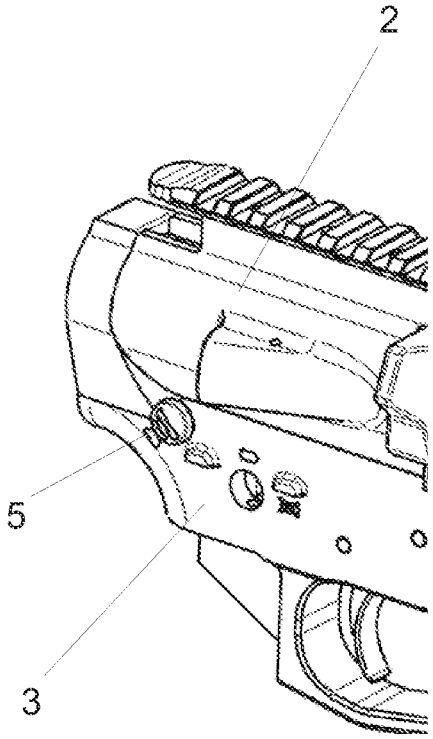
FIGS. 2A and 2B show schematically situations where the rear take-down pin is fixed and detached.
Figure 2B:
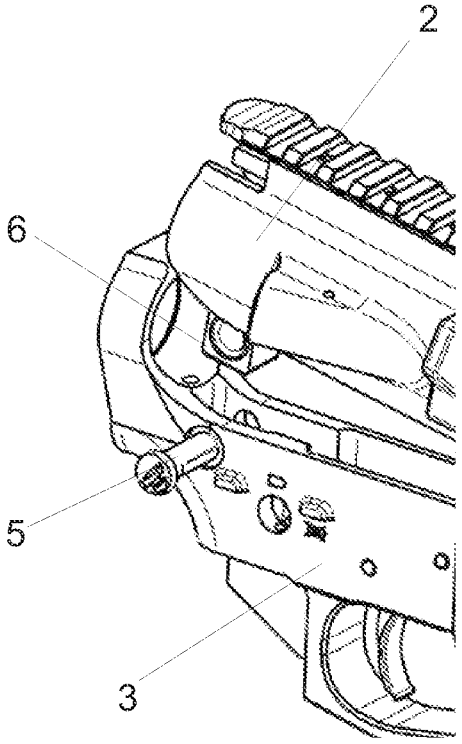

FIG. 2A shows schematically the situation wherein the upper receiver 2 and lower receiver 3 are fixed and tightened against each other in accordance with the present invention with the rear take-down pin 5. FIG. 2B shows schematically the situation where the rear take-down pin 5 is pulled out and the upper receiver 2 and the lower receiver 3 are turned around the front take-down pin 4 which is still at its fixed position.

FIG. 2B also shows the part 6 extending from the lower surface of the upper receiver 2. When the upper receiver 2 and the lower receiver 3 are placed against each other the part 6 is placed between the sidewalls of lower receiver and the rear take-down pin 5 can be pushed through the through-hole in the part 6 and through a through-hole in the other sidewall of the lower receiver.

When the rear take-down pin 5 is in pulled-out position as shown in FIG. 2B, it is still fixed in the lower receiver with a locking mechanism that prevents the rear take-down pin to be completely removed from the lower receiver. The locking mechanism will be more closely discussed in relation to FIGS. 3A and 3B, and FIG. 6A.

Figure 3A:
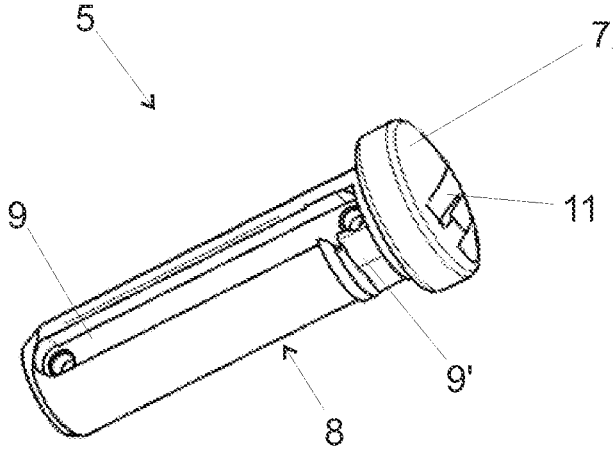
FIGS. 3A and 3B show schematically an embodiment of a rear take-down pin of the invention.
Figure 3B:
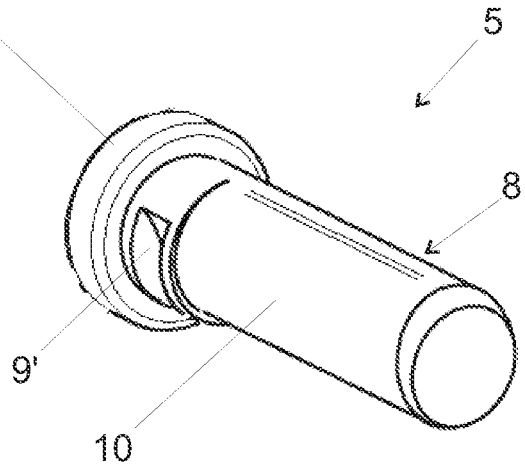

FIGS. 3A and 3B show schematically the rear take-down pin 5. The rear take-down pin 5 comprises a head 7 and a pin portion 8. In the pin portion 8 is formed a groove 9 extending along part of the length on the pin portion. In this groove 9 sets a head of the first spring-loaded locking pin (not shown in figures), which first locking pin prevents complete removal of the rear take-down pin 5 from the lower receiver. The length of the groove 9 in longitudinal direction of the pin portion 8 allows the rear take-down pin 5 to be moved between fixed and detached position in relation to the upper receiver 2 and lower receiver 3.

The groove 9 extends with a groove portion 9' near the head 7 of the rear take-down pin along the round surface of the pin portion 8. This groove portion 9' allows the rear take-down pin 5 to be turned around its longitudinal axis when the rear take-down pin is in its fixed position in relation to the upper receiver 2 and lower receiver 3.

The pin portion 8 comprises a recessed area 10 formed on the surface of the pin portion, in which recessed area the surface of the pin portion is gradually lowered from the traditional circular form of a take-down pin causing eccentricity in the pin portion on the area of the recess. In the recessed area 10 the cross-sectional area is smaller than of the circular portion of the pin portion 8. In the embodiment the recessed area 10 is formed on the surface of the pin portion outside the groove 9, 9' and it extends in longitudinal direction of the pin portion 8 from the end opposite to the head 7 near vicinity of the groove portion 9'.

In the surface of head 7 is formed grooves 11, which allow the turning of the rear take-down pin 5 in relation to its longitudinal axis. The grooves 11 in this embodiment are formed in a shape to receive an edge area of a cartridge so that no additional tools for turning the rear take-down pin 5 are required.

The opposite end surface of the rear take-down pin 5 in relation to the head 7 may also be equipped with a suitable groove or recess (not shown) for turning the rear take-down pin with a tool, since this surface is typically also accessible outside the lower receiver 3 when the rear take-down pin is in its fixing position. The groove or recess can be a hexagonal recess, for example, for allowing the rear take-down pin 5 to be turned with a corresponding Allen key.

Figure 4A:
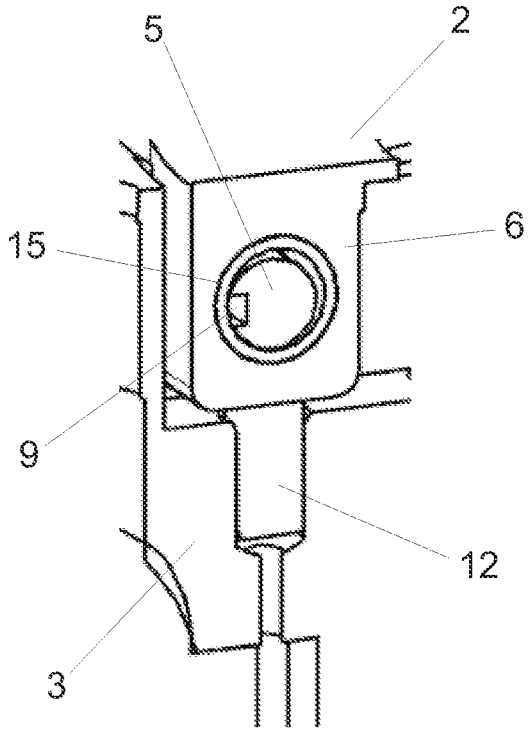
FIGS. 4A and 4B show schematically cross-sections of the lower and upper receiver with the rear take-down pin of FIGS. 3A and 3B in inserting position and in tightened position.
Figure 4B:
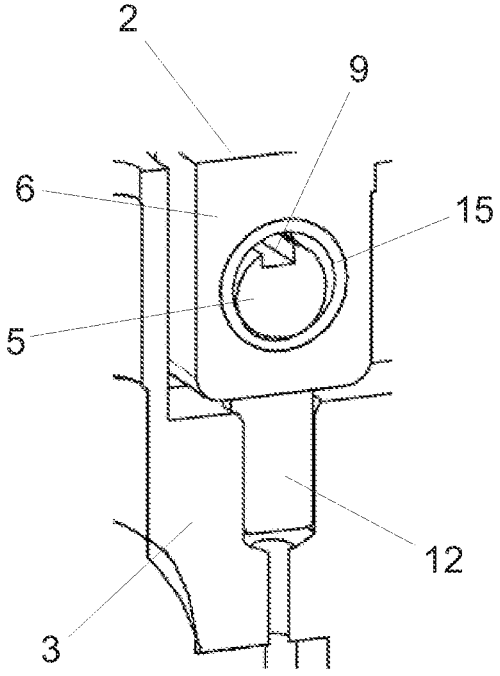

FIGS. 4A and 4B show schematically partial cross-sections the upper receiver 2 and lower receiver 3 connected to each other at the area of the part 6 of the upper receiver and the rear take-down pin 5 is inserted at its place in fixing position.

In FIG. 4A is shown the rear take-down pin 5 in its inserting orientation. In this orientation the recessed area 10 is towards a flexible piece 12 fixed in the lower receiver 3 and located directly under the part 6 of the upper receiver 3. This orientation allows easy insertion of the rear take-down pin 5 through the through-holes of the upper receiver 2 and lower receiver 3 to its fixing position. The recessed area 10 extending from the end of the read take-down pin 5 (as shown in FIG. 3A) allows little deviation in the concentricity between the through holes in the lower receiver 3 and in the upper receiver 2 when the rear take-down pin is inserted through these trough-holes to its fixing position.

Once the rear take-down pin 5 is in its fixing position, i.e. its head 7 is against the outer surface of the lower receiver 3 and the opposite end is through the other through-hole on the opposite side of the lower receiver, the rear take-down pin is turned about 90 degrees in this embodiment to a position shown in FIG. 4B.

In the position of FIG. 4B the recess area 10 of the rear take-down pin 5 is facing towards the rear end of the lower receiver 3, and the non-recessed outer surface of the rear take-down pin now presses the part 6 towards the flexible piece 12. Thus the turning of the rear take-down pin 5 tightens the connection between the upper receiver 2 and the lower receiver 3, and also presses the part 6 more tightly against the flexible part 12 forcing the flexible part to compress more.

The flexible part 12 is first compressed by the part 6 of the upper receiver 2 when the upper receiver is pressed against lower receiver 3 in order to align the through-holes in the upper and lower receiver for inserting the rear take-down pin 5. When the rear take-down pin 5 is rotated to obtain the tightening effect between the upper receiver 2 and the lower receiver 3, the flexible part 12 is compressed further.

The flexible part 12 in this embodiment is a rubber piece, which is fixed in a hole formed for it in the lower receiver 3 with glue.

FIGS. 4A and 4B also illustrate a metal bushing 15 set in the through-hole in the part 6 of the upper receiver 2, which in this embodiment is a steel bushing. The bushing 15 defines the inner diameter of the through-hole in part 6 and improves the durability, especially by maintaining its circularity, during the use of the weapon 1.

Figure 5:
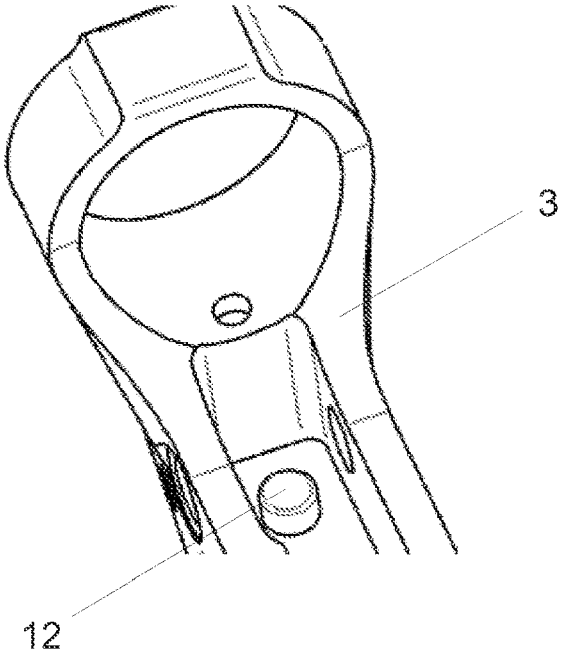
FIG. 5 shows schematically part of the lower receiver in accordance with an embodiment of the present invention.

FIG. 5 further illustrates the location of the flexible piece 12 inside the lower receiver 3 and in relation to the through holes formed in the walls of the lower receiver for the rear take-down pin 5.

Figure 6A:
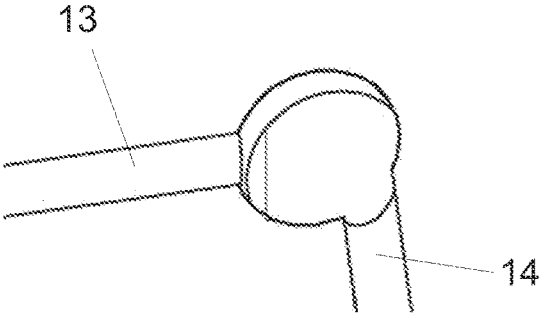
FIGS. 6A and 6B show schematically one embodiment for locking the rear take-down pin.
Figure 6B:
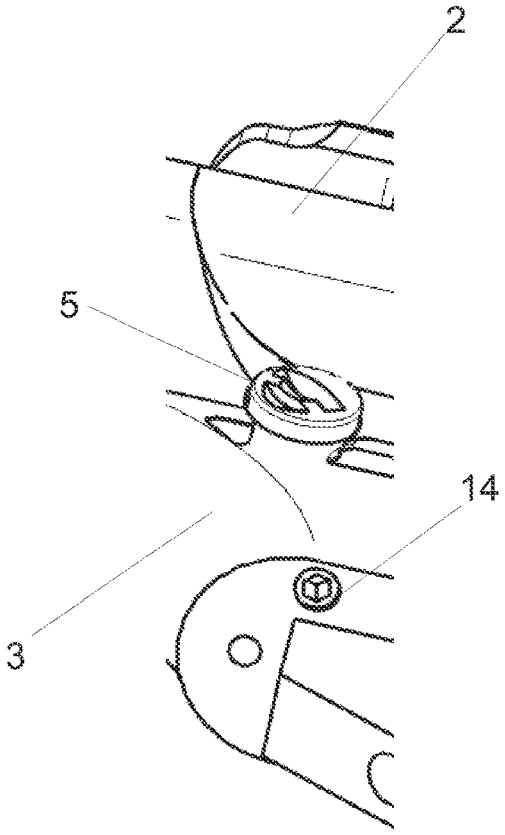

FIGS. 6A and 6B schematically illustrate one embodiment for locking the rear take-down pin 5. In FIG. 6A is shown a cross-section of the wall of the lower receiver 3 at the area of the through-hole for the head end of the rear take-down pin 5. In FIG. 6B is shown view from the area of the lower receiver 3 which will be covered with a pistol grip (not shown) when it is connected to the lower receiver.

FIG. 6A shows two channels 13 and 14 which are formed inside the wall of the lower receiver 2 and which open to the wall to the opening formed for the head end of the rear take-down pin 5. In channel 13 is inserted the first spring-loaded locking pin as mentioned in discussion of FIG. 2B as well as 3A and 3B. The head of the first locking pin sets itself in the groove 9, 9' of the rear take-down pin 5 (see FIGS. 3A and 3B) and prevents the complete removal of the rear take-down pin from the lower receiver 3.

The channel 14 is formed for a second spring-loaded locking pin (not shown in figures), which prevents the rear take-down pin 5 to turn by itself when the weapon 1 is operated. The eccentric location of the opening of the channel 14 in the wall of the opening in the lower receiver 3, and the corresponding placement of the head of the second locking pin, allows embodiment where the second spring-loaded locking pin prevents the turning of the rear take-down pin in the releasing direction but allows the turning in tightening direction. This embodiment can be implemented so that there are a plurality of recesses for receiving the head of the second locking pin formed in circumference of the rear take-down pin 5, which recesses are formed so, that the side walls of the recesses push the head of the second locking pin out of the recess when the rear take-down pin is turned in tightening direction, but the opposite side walls of the recesses does not create the same pushing effect.

Alternatively an opening on the outer side surface of the lower receiver 2 can be made on the area of the channel 14 and extending from the outer surface to the channel. In this opening may be inserted a release lever for releasing the locking obtained with the second spring-loaded locking pin, with a movement in the direction of the channel 14, for example.

In FIG. 6B is shown the area where the opposite end of the channel 14 opens, and via which opening the second spring-loaded locking pin may be inserted. This end of the channel 14 is preferably closed with a suitable screw so that the pistol grip can be removed without fear of losing the second locking pin or the related spring.

The specific exemplifying embodiment of the invention shown in figures and dis-cussed above should not be construed as limiting. A person skilled in the art can amend and modify the embodiment described in many evident ways within the scope of the attached claims. Thus, the invention is not limited merely to the embodiment described above.

The invention claimed is:

1. A connection for connecting an upper receiver to a lower receiver of a weapon, which connection comprises front and rear take-down pins, and through-holes formed in both receivers for inserting the take-down pins through these holes to connect the upper and lower receiver to each other wherein the rear take-down pin comprises an eccentric portion at its length for tightening the receivers against each other by turning the rear take-down pin.

2. The connection according to claim 1, wherein the eccentric portion of the rear take-down pin is located at least at an area of the through-hole formed in the upper receiver when the rear take-down pin is at its place.

3. The connection according to claim 1, wherein in a cross-sectional area of the rear take-down pin is smaller within the eccentric portion than outside the eccentric portion.

4. The connection according to claim 1, wherein in the head of the rear take-down pin is formed a groove or recess for facilitating turning of the rear take-down pin with a tool.

5. The connection according to claim 1, wherein the connection comprises a first spring-loaded locking pin located in a first channel formed inside a wall of the lower receiver, which first locking pin is configured to prevent complete removal of the rear take-down pin from the lower receiver, and wherein the rear take-down pin comprises a groove extending along part of a length of pin portion of the rear take-down pin into which groove a head of the first locking pin sets and which groove allows the rear take-down pin to be slid through the through-hole formed in the upper receiver.

6. The connection according to claim 1, wherein the connection comprises a second spring-loaded locking pin located in a second channel formed inside a wall of the lower receiver, which second locking pin is configured to prevent rotating of the rear take-down pin in at least a first rotational direction, and wherein the rear take-down pin comprises a recess for receiving ahead of the second locking pin.

7. The connection according to claim 6, wherein a plurality of recesses for receiving the head of the second locking pin are formed in circumference of the rear take-down pin, which recesses are formed so, that side walls of the recesses push the head of the second locking pin out of the recess when the rear take-down pin is rotated in an opposite rotational direction in relation to the first rotational direction.

8. The connection according to claim 1, wherein the connection further comprises a flexible piece fixed inside the lower receiver, which piece deforms when the upper receiver is pressed against the lower receiver in order to at least partially align the through-holes in the upper receiver and in the lower receiver for insertion of the rear take-down pin.

9. The connection according to claim 8, wherein the flexible piece fixed inside the lower receiver is a rubber piece glued in the lower receiver.

10. The connection according to claim 1, wherein the through-hole formed in the upper receiver for the rear take-down pin comprises a metal bushing.

* * * * *